United States Patent [19]

Leskinen

[11] Patent Number: 4,791,748

[45] Date of Patent: Dec. 20, 1988

[54] RECOIL LUG AND RECEIVER FOR A GUN

[75] Inventor: Martti Leskinen, Jyväskylä , Finland

[73] Assignee: Sako-Valmet Oy, Finland

[21] Appl. No.: 72,895

[22] Filed: Jul. 14, 1987

[30] Foreign Application Priority Data

Jul. 15, 1986 [FI] Finland ..... 862946

[51] Int. Cl.[4] ..... F41C 21/22

[52] U.S. Cl. ..... 42/75.02

[58] Field of Search ..... 42/16, 75.02

[56] References Cited

U.S. PATENT DOCUMENTS

| | | | |
|---|---|---|---|
| 1,166,910 | 1/1916 | Johnson | 42/75.02 |
| 1,234,783 | 7/1917 | Mauser | 42/75.02 X |
| 1,628,798 | 5/1927 | Nelson | 42/75.02 |
| 2,587,937 | 3/1952 | Waltke, Jr. | 42/75.02 |
| 3,653,140 | 4/1972 | Alday | 42/16 |

*Primary Examiner*—Ted L. Parr

*Attorney, Agent, or Firm*—Steinberg & Raskin

[57] ABSTRACT

The present invention relates to a receiver and a recoil lug for a gun. The receiver and the recoil lug with which the receiver is arranged to be fastened to the stock of the gun, are manufactured as separate pieces in accordance with the invention. A characteristic of the invention is that the receiver is manufactured by cold-hammering, inner and outer surfaces thereof are finished. Another feature of the present invention is that the recoil lug is fastened to the receiver by driving the same to form a tight force fit between the two, with guiding surfaces for the gun barrel being formed onto the receiver and onto the recoil lug. The receiver is manufactured to be substantially symmetrical with respect to a longitudinal axis thereof, with an external, shouldered connecting surface being shaped onto the receiver. An annular inner surface is shaped onto the recoil lug which, together with the connecting surface of the receiver, forms the force fit.

16 Claims, 1 Drawing Sheet

RECOIL LUG AND RECEIVER FOR A GUN

BACKGROUND OF THE INVENTION

The present invention relates to a receiver and a recoil lug for a gun, in which the receiver and the recoil lug, with which the receiver is arranged to be fastened to the stock of the gun, are manufactured as two separate pieces.

The object of the invention is specifically to provide a receiver and a recoil lug for such a cylinder-bolted, large caliber target rifle, which is expected to be highly accurate and reliable. Traditionally, the recoil lug of a cylinder-bolted rifle is manufactured from solid material together with the receiver. The recoil-receiving surface is then milled onto the receiver. In other words, the surplus material is machined from the receiver. This causes high material losses and increased machining times. Therefore, the combination of the receiver and the recoil lug manufactured in this traditional manner is very expensive, which raises the price of the gun.

On the other hand, receivers have also been manufactured as eccentric pieces, such as hot-forgings and castings, in which case the equipment and mold costs have been extremely high. In order to reduce the receiver manufacturing costs, efforts have been made to substitute a separate part for the recoil lug, however this has impaired the accuracy of the gun, thus preventing the reduction of the price of the receiver in target guns. Therefore, this kind of separate recoil lug has been used in hunting weapons only. Usually, this kind of separate recoil lug is fastened to the receiver so that the receiver is shaped asymmetric by positioning the hole for the cartridge and the bolt in the top edge of the receiver, thus providing the bottom edge with more material. Then, a transverse groove, for instance a T-groove or a dovetail groove or similar, is made in the receiver, with the recoil lug hit crosswise into this groove with respect to the receiver.

Unnecessarily large amounts of material must also be used in this method, since it has not been possible to make the receiver symmetrical because it has been necessary to leave room for the recoil lug in the bottom section of the receiver.

As stated above, arrangements made of hot-forgings are also know in the prior art. The receiver and the recoil lug are also made as a single piece by the hot-forging. After forging, it is necessary to finish the piece with machining methods. This solution is thus time-consuming and expensive.

SUMMARY OF THE INVENTION

Accordingly, it is an object of the present invention to provide a new receiver and recoil lug for a gun, which is less expensive than receivers and recoil lugs in the prior art.

It is also an object of the present invention to provide a new receiver and recoil lug for a gun of higher quality, in such a manner that the present invention can also be used in target rifles in order to reduce the price thereof and improve the quality thereof.

It is a further object of the present invention to improve manufacturing of a receiver and recoil lug for a gun.

It is another object of the present invention to improve accuracy and reliability in a receiver and recoil lug for a gun.

These and other objects are attained by the present invention which is directed to a device for a gun comprising a receiver and a recoil lug by which the receiver is arranged to be fastened to a stock of a gun. The receiver and recoil lug are formed as two separate pieces, and are fastenable to one another by a tight force fit. The receiver and the recoil lug each comprise respective guiding surfaces for a barrel of the gun. The receiver is formed to have a finished quality for fastening to the recoil lug by the tight force fit, with the receiver being formed by cold-hammering.

The present invention is also directed to a method for manufacturing a gun, which comprises the steps of forming a receiver of the gun by cold-hammering inner and outer surfaces thereof to finish quality for fitting together with a recoil lug for a stock of the gun, and driving the receiver and recoil lug together to form a tight force fit.

The receiver is entirely finished in a single stage.

In order to attain the aforedescribed objects and others set forth here below, a principal characteristic feature of the present invention is that the receiver is manufactured by cold-hammering inner and outer surfaces thereof to such a finished quality that the recoil lug can be fastened to the receiver by driving the recoil lug to form the tight force fit with the receiver, with guiding surfaces for the gun barrel being formed on the receiver and the recoil lug.

Several benefits are attained by the present invention when compared to the prior art. For example, in one feature in accordance with the present invention, the receiver is manufactured by a method which is entirely new in this connection i.e. cold-hammering. With this method, the receiver can be finished in a single stage. All necessary guiding surfaces and other similar surfaces are finished by cold-hammering in a single stage or turn, because with cold-hammering, guiding surfaces are created on the receiver with a roughness only approximately 1/20 of what has been previously possible with cut-machining methods.

With cold-hammering, it is also possible to make the receiver symmetrical, i.e. with respect to a longitudinal axis thereof. By hammering on a mandrel, it is also possible to shape the bolt guide grooves, again in a single stage. The joint between the receiver and the recoil lug will be strong so that, from the point of view of the end result, the present invention is at least as good as the case where the receiver and the recoil lug are made from solid material and from one piece. However, the bolt receiver and recoil lug in accordance with the present invention are substantially cheaper as compared to those made of a single piece of solid material. When the receiver is cold-hammered ready, there is no need to machine the receiver in any way. Opening the cartridge-feed hole into the receiver is all that is needed. This step is required in all other known methods. Since the guide surfaces required in the receiver are hammered "mirror surfaces" of very high accuracy in accordance with the present invention, plays will be minimized while faults due to the receiver will be eliminated. When manufacturing receivers with traditional methods, several sources of faults remain, detrimentally affecting the use of the gun.

BRIEF DESCRIPTION OF THE DRAWINGS

The present invention will be described in greater detail below, with reference to an exemplary embodiment illustrated in the accompanying drawings, in which.

DESCRIPTION OF THE PREFERRED EMBODIMENTS

Figure 1:
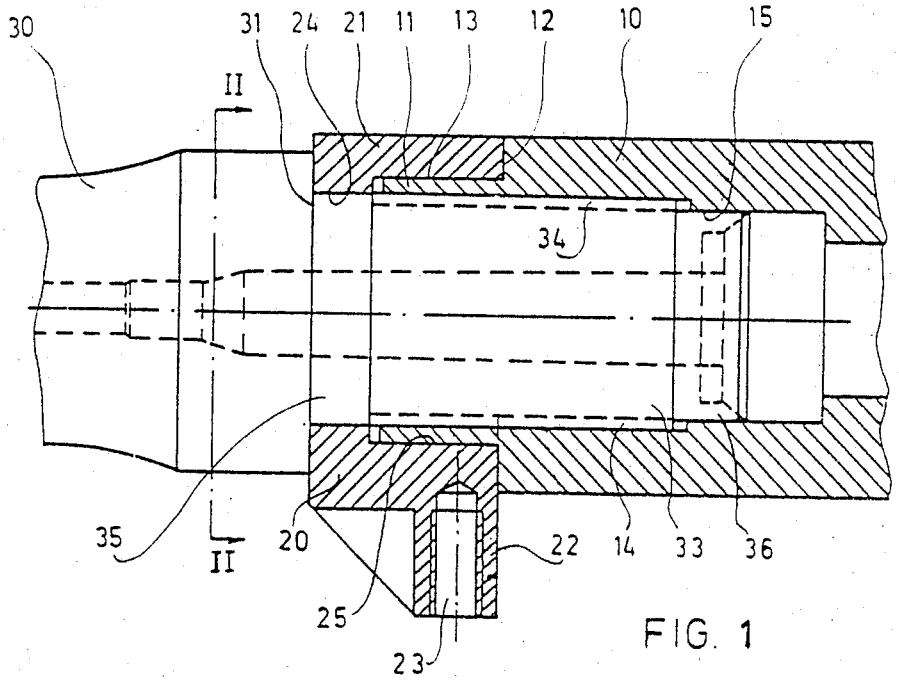
FIG. 1 is a side view, partially in section, of an embodiment in accordance with the present invention, with a receiver and a recoil lug being shown in section.
Figure 2:
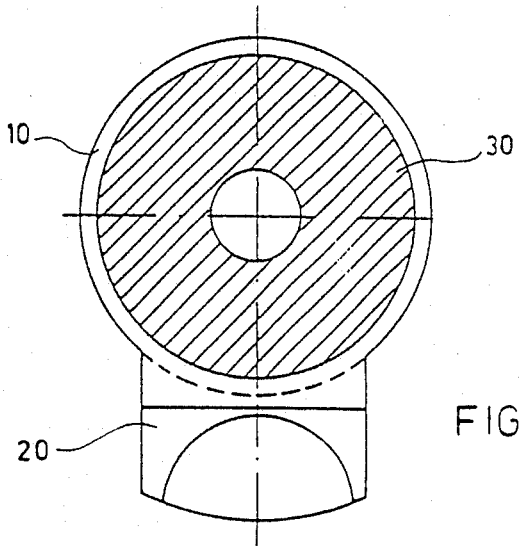
FIG. 2 is a sectional view along line II—II in FIG. 1.

In the figures, the receiver is denoted by reference numeral 10, a separate recoil lug by reference numeral 20, and a gun barrel by reference numeral 30. The receiver 10 is, in accordance with the present invention, manufactured by cold-hammering, preferably from a tubular blank so that a mandrel (not illustrated) is installed within the blank, and the blank is hammered between the jaws of the hammering machine so that the blank rotates during the hammering. With this kind of arrangement, the receiver 10 will be fully symmetrical, i.e. with respect to a longitudinal axis thereof.

The receiver 10 is hammered so that a narrow section 11 is hammered at the gun-barrel end of the receiver 10 which extends over a certain distance in the receiver 10, ending at a shoulder 12. Because cold-hammering is a method by which the workpiece acquires very smooth and accurate surfaces having RA-values on the order of less than 0.1, necessary joining and guiding surfaces 13, 15 can be shaped onto the receiver 10 the hammering. It is thus possible to create a connecting surface 13 on the outer surface of the narrow section 11 of the receiver 10, against which the recoil lug 20 is intended to be fitted. Also, an internal thread 14 to which the gun barrel 30 is to be screwed, is formed onto the inner surface of the receiver 10. The internal thread 14 can be cut onto the receiver 10 by machining. The inner thread 14 can also be shaped in conjunction with the cold-hammering in the same stage.

The mandrel (not illustrated) used in the cold-hammering of the receiver 10, may be so shaped that the guiding surfaces (not illustrated) required for the bolt of the gun, can be created on the inner surface of the receiver 10 during the cold-hammering. The guide grooves can favorably be shaped into the receiver 10 just during the hammering stage, since by cold-hammering it is possible to make the guide surfaces extremely smooth and accurate, as stated above. The cylinder lock is usually made by grinding, while the plays between the bolt and the receiver 10 can be minimized. Faults due to the receiver can then be essentially eliminated altogether. When the receiver 10 has been finished in the described manner by cold-hammering, all that is needed is to open a cartridge-feed opening into the receiver 10, after which the receiver 10 is essentially completed. The receiver 10 is manufactured substantially symmetrical with respect to a longitudinal axis thereof.

A recoil lug 20, separate from the receiver 10, is used in accordance with the present invention. The recoil lug 20 will now be described in greater detail. The recoil lug 20 comprises an annular section 21 with which the recoil lug 20 is fastened to the recoil lug 10, and a protruding part 22 extended essentially radially out from the annular section 21, with the recoil lug 20 being fastened to the stock (not illustrated) of a gun at the protruding part 22. The protruding section 22 has an internal thread 23 for fastening to the gun stock.

The recoil lug 20 is manufactured by a suitable method, for instance by machining. An inner surface 25 at which the recoil lug 20 is intended to be fastened to the joining surface 13 of the narrow part 11 of the receiver 10, is shaped onto the annular section 21 as illustrated. The inner surface 25 is so dimensioned that the inner surface 25 and the joining surface 13 of the receiver 10 join together to from a tight force fit, as also illustrated in the figures. In other words, the receiver 10 comprises an external, shouldered 12 connecting surface 13, and the recoil lug 20 comprises an annular inner surface 25 shaped substantially complementary to the external, shouldered 12 surface 13 of the receiver 10.

Another annular guide surface 24 is shaped onto the recoil lug 20, i.e. the annular section 21 thereof, with a diameter smaller than the diameter of the inner surface 25 of the annular section 21. This other guide surface 24 provided on the recoil lug 20, is arranged to provide necessary guidance for the gun barrel 30. The guiding surface 24 formed onto the recoil lug 20, and the guiding surface 15 formed onto the receiver 10 for the gun barrel are arranged, in a longitudinal direction of the receiver 10, on opposite sides of a fastened point or area 22, 23 at which the receiver 10 and the recoil lug 20 are arranged to be fastened to the gun stock.

A shoulder 31 is formed on the gun barrel 30 and arranged to mate with an end surface of the recoil lug 20 when the barrel 30 is fastened onto the receiver 10 as illustrated. From the shoulder 31, the barrel 30 continues as a protruding connecting part 33 which projects into receiver 10 for fastening the barrel 30 onto the receiver 10. At the base end of the connecting part 33, in the immediate vicinity of the shoulder 31, a smooth first guide part 35 is formed onto the gun barrel 30, with an outer surface of this guide part 35 being arranged to mate with the second guide surface 24 formed onto the recoil lug 20, in order to provide the gun barrel 30 with appropriate guidance.

The first guide part 35 of the barrel 30 and the second guide surface 24 of the recoil lug 20, together form a tight running fit. In the area of a free end of the connecting part 33 of the gun barrel 30, another smooth guiding section 36 is formed, and extends somewhat towards the base of the connecting part 33 from the free end thereof, as illustrated. This guiding section 36 is disposed to mate with the first guiding surface 15 shaped into the receiver 10, so that this second guide section 36 of the connecting part 33 and the first guiding surface 15 of the receiver 10, together form a tight running fit. The gun barrel 30 thus obtains guidance both from the receiver 10 and from the recoil lug 20.

An external thread 34 mating the internal thread 14 formed into the receiver 10, has also been shaped onto the connecting part 33 in the region between the first guiding section or part 35 and the second guiding section or part 36 on the gun barrel 30. Thus, the gun barrel 30 is fastened on into the receiver 10 by screwing the external thread 34 of the barrel 30 onto the inner thread 14 of the bolt frame 10 as illustrated.

When the receiver 10 and the recoil lug 20 have been completed, the system is assembled as follows. The recoil lug 20 is pressed, for instance in a press, onto the receiver 10 so that the inner surface 25 of the annular part 21 of the recoil lug 20 fits on top of the joining or joint face 13 of the receiver 10, with the annular part 21 of the recoil lug receiver 20 being secured by pressing the same to the shoulder 12 of the receiver 10. These surfaces 13 and 25 together form a tight force fit as stated above, after which the combination of the receiver 10 and the recoil lug 20 corresponds to the case where the bolt frame 10 and the recoil lug 20 have been shaped from one and the same piece.

The protruding part 22 and the thread 23 are formed onto the recoil lug 20 so that the protruding part 22 and the thread 23 are located at the inner surface 25 of the annular part 21, as also illustrated in the figures. Thus, the tightening force of the tightening screw (not illustrated) by which the receiver 10 is fastened onto the gun stock, is applied at this force fit, so that the tightening force is not applied directly to the gun barrel. Therefore, the fastening of the receiver 10 to the gun stock does not attempt to pull the gun barrel 30 aslant. Therefore, such a factor which disturbs the accuracy of the rifle, is eliminated by the present invention. As soon as the recoil lug 20 is secured onto the receiver 10, the gun barrel 30 can be screwed into the combination of the recoil lug 20 and the receiver 10. The barrel 30 will then receive its guidance at two points, firstly at the receiver 10 and secondly at the recoil lug 20, as stated above. Disturbances due to fastening of the barrel 30 to the receiver 10, are therefore minimized or eliminated entirely.

The present invention has been described above as an example with reference to the accompanying figures. It is not at all intended to restrict the invention to the exemplary embodiment illustrated herein and described above. Several modifications are possible within the inventive ideas and concepts set forth above. Accordingly, the preceding description of the present invention is merely exemplary, and is not intended to limit the scope thereof in any way.

What is claimed is:

1. A gun component, comprising
a receiver for receiving a barrel of a gun, and
a recoil lug, by which said receiver is arranged to be fastened to a stock of the gun,
said receiver and recoil lug being formed as two separate pieces and formed to be fastenable to one another by a tight force fit, and
said receiver and recoil lug each comprising respective contact surfaces for contacting the barrel of the gun,
wherein said respective contact surfaces are formed on inner circumferential surfaces of said receiver and recoil lug.

2. The combination of claim 1, wherein said receiver is formed by cold-hammering.

3. The combination of claim 1, wherein
said receiver additionally comprises an external, shouldered, connecting surface,
said recoil lug comprises an annular inner surface shaped substantially complementary to said external, shoulder surface of said receiver,
with said connecting surface of said receiver and said annular inner surface of said recoil lug formed to constitute said tight force fit when said recoil lug and receiver are joined.

4. The combination of claim 3, wherein said receiver is formed substantially symmetrical with respect to a longitudinal axis thereof.

5. The combination of claim 3, wherein
an internal diameter of said contact surface of said recoil lug is smaller than an internal diameter of said annular inner surface of said recoil lug.

6. The combination of claim 3, wherein said recoil lug comprises an end surface positioned to mate with a shoulder formed on the gun barrel.

7. The combination of claim 1, wherein said respective contact surfaces of said receiver and recoil lug are situated in a direction of receiving the gun barrel, on opposite sides of an area at which said receiver and recoil lug are arranged to be fastened to the gun stock.

8. The combination of claim 7, wherein said force fit is located at the fastening area to the gun stock.

9. The combination of claim 7, wherein said recoil lug comprises, at said fastening area
a radially protruding section, and
an internally threaded recess in said protruding section and extending radially outwardly from said recoil lug.

10. The combination of claim 1, wherein said respective contact surfaces of said receiver and said recoil lug are arranged to form tight fits with guiding parts of the gun barrel when the barrel is received therein.

11. A gun component, comprising
a receiver for receiving a barrel of a gun, and
a recoil lug, by which the receiver is arranged to be fastened to a stock of the gun,
said receiver and recoil lug being formed as two separate pieces and being formed to be fastenable to one another by a tight force fit, and
said receiver and recoil lug each comprising respective contact surfaces for contacting a barrel of the gun,
wherein said respective contact surfaces are formed on inner circumferential surfaces of said receiver and recoil lug, and
said receiver is formed by cold-hammering to have suitable finished quality for fastening to said recoil lug by tight force fit.

12. The combination of claim 11, wherein
said receiver additionally comprises an external, shouldered, connecting surface,
said recoil lug comprises an annular inner surface shaped substantially complementary to said external, shouldered surface of said receiver,
with said connecting surface of said receiver and said annular inner surface of said recoil lug formed to constitute said tight force fit when said recoil lug and receiver are joined, and
said receiver is formed substantially symmetrical with respect to a longitudinal axis thereof.

13. The combination of claim 11, wherein said respective contact surfaces of said receiver and recoil lug are situated in a direction of receiving the gun barrel, on opposite sides of an area at which said receiver and recoil lug are arranged to be fastened to the gun stock.

14. The combination of claim 13, wherein said force fit is located at the fastening area to the gun stock.

15. The combination of claim 11, wherein said respective contact surfaces of said receiver and said recoil lug are arranged to form tight fits with guiding parts of the gun barrel when the barrel is received therein.

16. A gun component, comprising
a receiver for receiving a barrel of a gun, and
a recoil lug, by which said receiver is arranged to be fastened to a stock of the gun,
said receiver and recoil lug being formed as two separate pieces and being formed to be fastenable to one another by a tight force fit, and said receiver and recoil lug each comprising respective contact surfaces for contacting the barrel of the gun, wherein said receiver additionally comprises an external, shouldered, connecting surface, said recoil lug comprises an annular inner surface shaped substantially complementary to said external shouldered surface of said receiver, with said connecting surface of said receiver and said annular inner surface of said recoil lug formed to constitute said tight force fit when said recoil lug and receiver are joined, wherein said receiver additionally comprises an inner threaded surface, adjacent said respective contact surface thereof, for receiving a threaded portion of the gun barrel.

* * * * *